United States Patent [19]

Hattler et al.

[11] 4,055,143

[45] Oct. 25, 1977

[54] RELEASE MATERIAL APPLICATION SEAL

[75] Inventors: Louis R. Hattler, Marion; Sukumaran K. Menon, Webster, both of N.Y.

[73] Assignee: Xerox Corporation, Stamford, Conn.

[21] Appl. No.: 724,446

[22] Filed: Sept. 20, 1976

[51] Int. Cl.[2] ..... B05C 11/04; B05C 1/06; G03G 15/20

[52] U.S. Cl. ..... 118/60; 118/261; 118/413

[58] Field of Search ..... 118/60, 261, 413, 407, 118/259; 432/60, 228; 219/216; 355/3 PJ, 15; 15/256.51

[56] References Cited

U.S. PATENT DOCUMENTS

| | | | |
|---|---|---|---|
| 2,439,802 | 4/1948 | Francis, Jr. | 118/413 |
| 3,026,842 | 3/1942 | Faeber | 118/261 |
| 3,379,171 | 4/1968 | Cordingly et al. | 118/261 |
| 3,762,365 | 10/1973 | Herzog | 118/261 X |
| 3,913,521 | 10/1975 | Bar-on | 118/60 |
| 3,934,547 | 1/1976 | Jelfo et al. | 118/60 |
| 3,935,836 | 2/1976 | Bar-on | 118/60 |

*Primary Examiner*—James Kee Chi

*Attorney, Agent, or Firm*—J. J. Ralabate; C. A. Green; H. Fleischer

[57] ABSTRACT

An apparatus in which a fluid release material is applied to a fuser member. The fuser member is in communication with a backup member and a sheet of support material having particles thereon passing therebetween. A sealing arrangement prevents sidewise leakage of the release material along the longitudinal axis of the fuser member.

6 Claims, 4 Drawing Figures

RELEASE MATERIAL APPLICATION SEAL

The foregoing abstract is neither intended to define the invention disclosed in the specification, nor is it intended to be limiting as to the scope of the invention in any way.

BACKGROUND OF THE INVENTION

This invention relates generally to a fusing apparatus employed in an electrostatographic printing machine, and more particularly concerns a sealing arrangement for an apparatus applying release material to a heated fuser member employed in the fusing apparatus.

In the process of electrostatographic printing, a latent image is recorded on a surface and rendered visible with particles. These particles are transferred to a sheet of support material, in image configuration. Thereafter, the particles are permanently affixed to a sheet of support material to form a copy of the orginal document. Electrostatographic printing includes both electrophotographic printing and electrographic printing. Electrophotographic printing employs a photoconductive member which is charged to a substantially uniform level to sensitize the surface thereof. A light image of an original document is projected onto the sensitized surface of the photoconductive member. This light image dissipates selectively the charge on the photoconductive member to record thereon an electrostatic latent image of the original document. Electrographic printing does not employ a photoconductive member or a light image to create a latent image of the original document. Generally, however, both of the foregoing processes utilize heat settable particles to develop the latent image. Afer the particles are transferred to a sheet of support material, heat is applied thereto so as to permanently affix the particles to the sheet of support material.

Various approaches have been devised for heating the particles on the sheet of support material to permanently fuse them thereto. For example, the sheet of support material with the particles thereon may pass through a pair of opposed rollers. In a system of this type, a heated fuser roller and a non-heated backup roller are employed. Preferably, the heated fuser roller has an outer surface covered with a polytetrafluoroethylene material, commonly referred to as Teflon, to which a release agent, such as silicone oil is employed. An alternate approach has been to utilize a bare metal heated roller which has a low molecular weight polyethylene applied thereto as a release agent. The release agent prevents the toner particles on the sheet of support material from adhering to the heated fuser roll. However, capillary action frequently causes migration of the release agent along the fuser roll longitudinal axis and leakage from the side marginal regions thereof.

Accordingly, it is a primary object of the present invention to improve the apparatus employed to apply release material to a fuser roll by preventing leakage of the release material along the fuser roll longitudinal axis.

SUMMARY OF THE INVENTION

Briefly, stated, and in accordance with the present invention, there is provided an apparatus for applying a fluid release material to a fuser member. The fuser member is in communication with a backup member. A sheet of support material having particles thereon passes therebetween with the particles contacting the fuser member.

Pursuant to the features of the present invention, the apparatus includes a housing defining a chamber for storing a supply of release material in operative communication with the fuser member. Means are provided for controlling the thickness of the layer of release material applied to the fuser member. Means, coupled to the controlling means, seal the space between the housing and the fuser member at opposed marginal side regions thereof to prevent leakage of the release material thereat.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
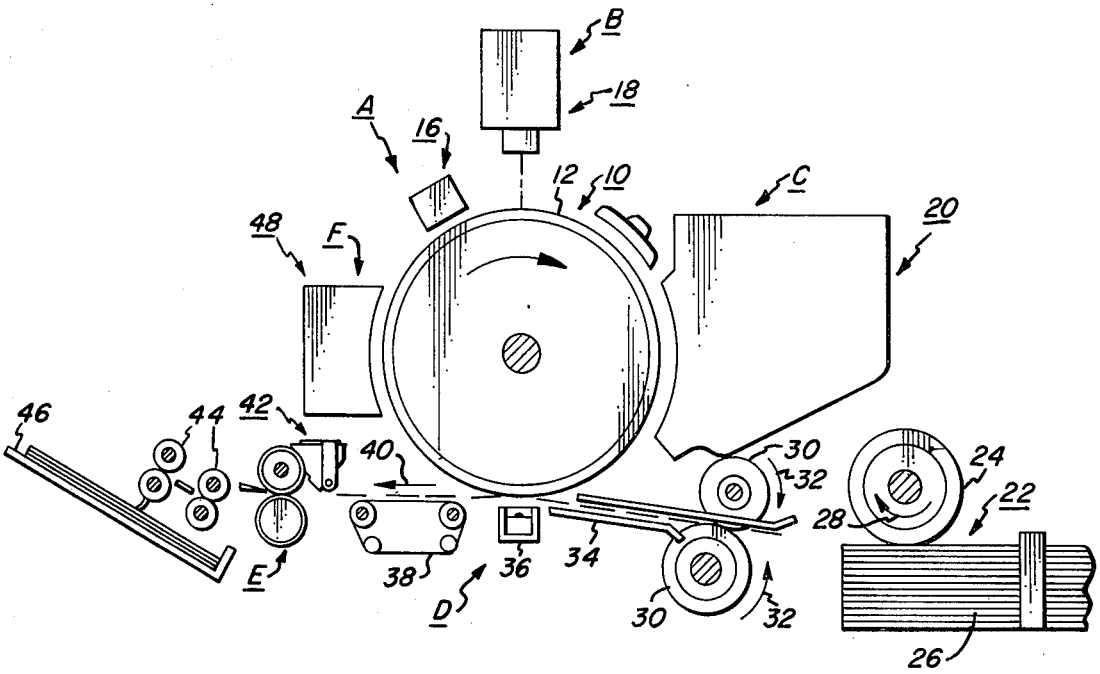
FIG. 1 is a schematic elevational view illustrating an electrophotographic printing machine incorporating the features of the present invention therein.

Turning now to the drawings, FIG. 1 depicts an electrophotographic printing machine incorporating the features of the present invention therein. In the drawings, like reference numerals have been utilized throughout to designate identical elements. The apparatus of the present invention insures that a fluid release material is applied to a heated fuser roller with leakage therefrom being minimized. This release material applicator is particularly well adapted for use in an electrophotographic printing machine. However, it will become evident from the following discussion that it is equally well suited for use in a wide variety of fusing devices and is not necessarily limited in its application to the particular embodiment shown herein.

Inasmuch as the art of electrophotographic printing is well known, the various processing stations employed in the FIG. 1 printing machine will be shown hereinafter as blocks and their operation described briefly with reference thereto.

As shown in FIG. 1, the electrophotographic printing machine employs a drum 10 having a photoconductive surface 12 entrained about and secured to the exterior circumferential surface thereof. Drum 10 rotates in the direction of arrow 14 to move photoconductive surface 12 through the various processing stations disposed about the periphery thereof. Preferably, photoconductive surface 12 is made from a selenium alloy of the type described in U.S. Pat. No. 2,907,906 issued to Bixby in 1961.

Drum 10 initially rotates a portion of photoconductive surface 12 through charging station A. At charging station A, a corona generating device, indicated generally by the reference numeral 16, charges photoconductive surface 12 to a relatively high substantially uniform potential level. A suitable corona generating device is described in U.S. Pat. No. 2,836,725 issued to Vyverberg in 1958.

Thereafter, the charged portion of photoconductive surface 12 rotates through exposure station B. Exposure station B includes an exposure mechanism, indicated generally by the reference numeral 18. Exposure mechanism 18 comprises a transparent platen upon which the original document being reproduced is positioned face down. Scan lamps, disposed beneath the transparent platen, illuminate the original document. The light rays, reflected from the original document, are directed through a lens forming a light image thereof. Scanning of the original document is achieved by oscillating a mirror in a timed relationship with the rotation of drum 10, or, in lieu thereof, by moving the lamp and lens system across the original document to form a flowing light image thereof. The light image is projected by a mirror through a slit and apertured plate onto the charged portion of photoconductive surface 12. Irradiation of the charged portion of photoconductive surface 12 selectively dissipates the charge thereon in accordance with the light image transmitted thereto. This records an electrostatic latent image on photoconductive surface 12 corresponding to the informational areas contained in the original document.

Next, drum 10 rotates the electrostatic latent image recorded on photoconductive surface 12 to development station C. Development station C comprises a developer unit having a housing with a supply of developer mix contained therein. The developer mix comprises carrier granules having toner particles adhering thereto. Generally, these carrier granules are formed from a ferromagnetic material while the toner particles are made from a heat settable plastic. Preferably, developer unit 20 is a magnetic brush system. In a typical magnetic brush system, a chain-like array of developer mix extends in an outwardly direction from the developer unit to contact the electrostatic latent image recorded on photoconductive surface 12. The latent image attracts electrostatically the toner particles from the carrier granules forming a toner powder image on photoconductive surface 12.

Prior to proceeding with the remaining processing stations disposed about the periphery of drum 10, the sheet feeding path will be described briefly. With continued reference to FIG. 1, a sheet of support material is advanced by sheet feeding apparatus 22 to transfer station D. Sheet feeding apparatus 22 includes a feed roller 24 contacting the uppermost sheet of a stack of sheets of support material 26. Feed roller 24 rotates in the direction of arrow 28 to advance successive uppermost sheets from stack 26 into the nip between register rolls 30. Register rolls 30 rotate in the direction of arrow 32 aligning and forwarding the advancing sheet of support material into chute 34. Chute 34 directs the advancing sheet of support material into contact with photoconductive surface 12 in a timed sequence, i.e., in registration with the toner powder image formed thereon. Thus, the sheet of support material moves into contact with the toner powder image on photoconductive surface 12 at transfer station D.

Transfer station D includes a corona generating device 36 which applies a spray of ions onto the backside of the sheet of support material opposed from photoconductive surface 12. The toner powder image adhering to photoconductive surface 12 is then attatched therefrom to the surface of the sheet of support material in contact therewith. After transferring the toner powder image to the sheet of support material, conveyor 38 advances the sheet of support material in the direction of arrow 40 to fixing station E.

Fixing station E includes a fuser assembly, indicated generally by the reference numeral 42. Fuser assembly 42 heats the transferred toner powder image to permanently affix it to the sheet of support material. The detailed structure of fuser assembly 42 and the release material dispenser associated therewith will be described hereinafter, in greater detail, with reference to FIG. 2.

After the toner powder image has been permanently affixed to the sheet of support material, the sheet of support material is advanced by a series of rollers 44 to catch tray 46 for subsequent removal therefrom by the machine operator.

Invariably, residual toner particles remain adhering to photoconductive surface 12 after the transfer of the toner powder image to the sheet of support material. These residual toner particles are removed from photoconductive surface 12 at cleaning station F. Cleaning station F includes a cleaning mechanism, generally designated by the reference numeral 48. Cleaning mechanism 40 comprises a corona generating device and a brush in contact with photoconductive surface 12. Initially, toner particles are brought under the influence of the corona generating device to neutralize the electrostatic charge remaining on photoconductive surface 12 and that of the residual toner particles. Thereafter, the neutralized toner particles are removed from photoconductive surface 12 by the rotatably mounted fibrous brush in contact therewith. Subsequent to cleaning, a discharge lamp floods photoconductive surface 12 with light dissipating any residual charge remaining thereon. In this manner, the charge on photoconductive surface 12 is returned to the initial level prior to recharging of photoconductive surface 12 at charging station A for the initiation of the next successive imaging cycle.

It is believed that the foregoing description is sufficient for purposes of the present application to illustrate the general operation of an electrophotographic printing machine incorporating the features of the present invention therein. Referring now to the specific subject matter of the present invention, FIGS. 2 through 4, inclusive, depict the apparatus for applying release material to the heated fuser roller of fuser assembly 42.

Fuser assembly 42 includes a heated fuser roller, indicated generally by the reference numeral 50, and a backup roller, indicated generally by the reference numeral 52. Fuser roller 50 cooperates with backup roller 52 to define a nip through which a sheet of support material 54 having a toner powder image 56 thereon passes. Sheet of support material 54 is oriented so that the toner powder image 56 thereon contacts fuser roller 50. A channel-shaped base (not shown) is provided for supporting fusing apparatus 42 in the electrophotographic printing machine of FIG. 1. A pair of brackets secured to the channel-shaped base by means of a right angle bracket support backup roller 52 rotatably.

Backup roller 52 rotates in the direction of arrow 58. Preferably, backup roller 52 includes a rigid steel core or shaft 60 having a Viton elastomeric surface or layer 62 dispoed thereover and affixed thereto. Shaft 60 is secured rotatably on brackets by a pair of ball bearings secured thereto by retaining rings.

A pair of brackets (not shown) having a generally E-Shaped configuration are provided for mounting fuser roller 50 rotatably in fusing apparatus 42. To this end, a pair of ball bearings mounted in each end of the support brackets provides a rotatable support. The bearings are secured in the brackets by retaining rings. A pair of end caps are attached to hollow cylinder or core 64 forming a part of fuser roller 50. Fuser roller 50 rotates in the direction of arrow 56. Hearing element 68 is supported internally of cylinder 64 and develops sufficient heat to elevate the surface temperature thereof. Preferably, cylinder 64 is heated to its operational temperature, i.e., about 285° F to about 295° F. For example, heating element 68 may include a quartz envelope having a tungsten resistance heating element disposed therein. Preferably, cylinder 64 is fabricated from any suitable material capable of efficiently conducting heat to the external surface thereof. For example, suitable materials are aluminum and alloys thereof, steel stainless steel, nickel and nickel alloys thereof, nickel plated copper, chromium plated copper, and alloys thereof. Fuser roller 64 requires about 420 watts peak power with the average power being about 320 watts, and about 100 watts being required for standby operation. Heating element 68 is supported internally of cylinder 64 by a pair of support brackets electrically connected to an external power supply.

Inasmuch as toner material in contact with fuser roller 64 readily wets the surface thereof, it is necessary to apply a release material thereon to prevent the toner particles from adhering thereto. Preferably, a low molecular weight substance which is solid at room temperature and has a relatively low viscosity at the operating temperature of fuser roller 64 is applied thereto. An example of such a material is a polyethylene manufactured by Allied Chemical Company and having a designation AC-8 homopolymer.

Figure 2:
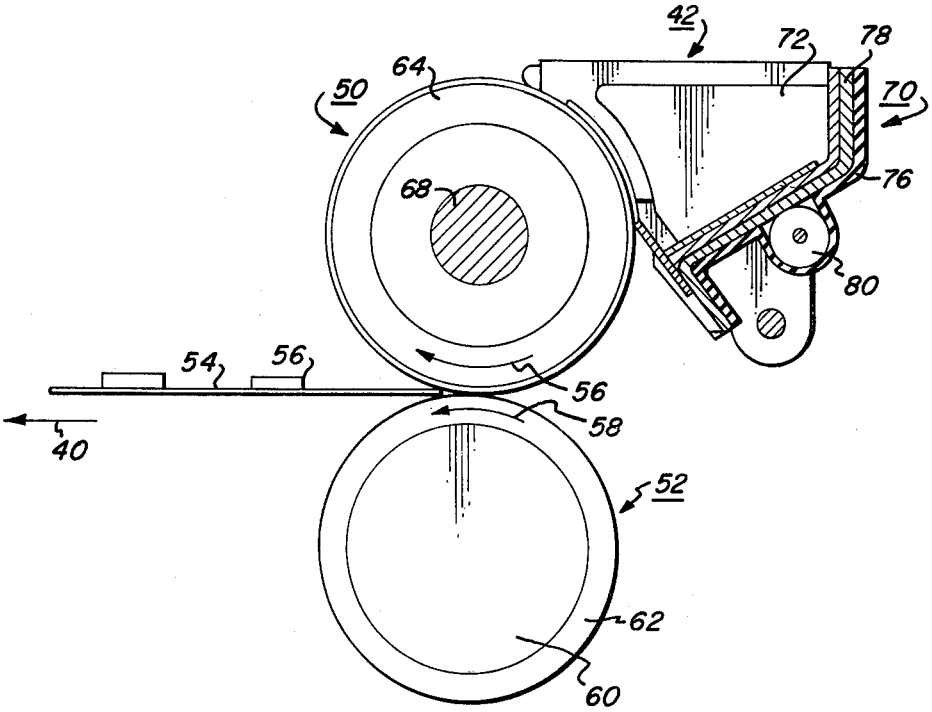
FIG. 2 is a schematic side elevational view depicting an apparatus for applying release material to a fusing apparatus employed in the FIG. 1 printing machine.

As shown in FIG. 2, housing 70 has an interior chamber 72 storing a supply of release material therein. Housing 70 is open ended permitting fuser roller 50 to pass therein so as to have the outer surface thereof coated with the release material in chamber 72. Metering blade 74 (FIG. 4) controls the thickness of the layer of release material applied to fuser roller 50. Housing 70 comprises an inner cast shell 78 and an outer molded shell 76 preferably made from an insulated material such as Silicon having a durometer hardness of about 50 on the Shore A hardness scale. Heating element 80 is mounted between outer shell 76 and inner shell 78. Preferably, heater 80 raises the temperature of housing 70 to maintain the release material contained in chamber 72 in a substantially fluid state. Heating element 80 is preferably a wire wound resistance type heating element encased in a stainless steel cartridge. A thermistor may be optionally position in chamber 72 and employed to control heating element 80 so as to maintain the temperature of the release material at the operating temperature, i.e., about 270° F, wherein it is a fluid. However, one skilled in the art will appreciate that while it is advantageous to operate heating element 80 in a closed loop fashion, it may also be operated in an open loop condition with a thermistor not being employed.

Figure 3:
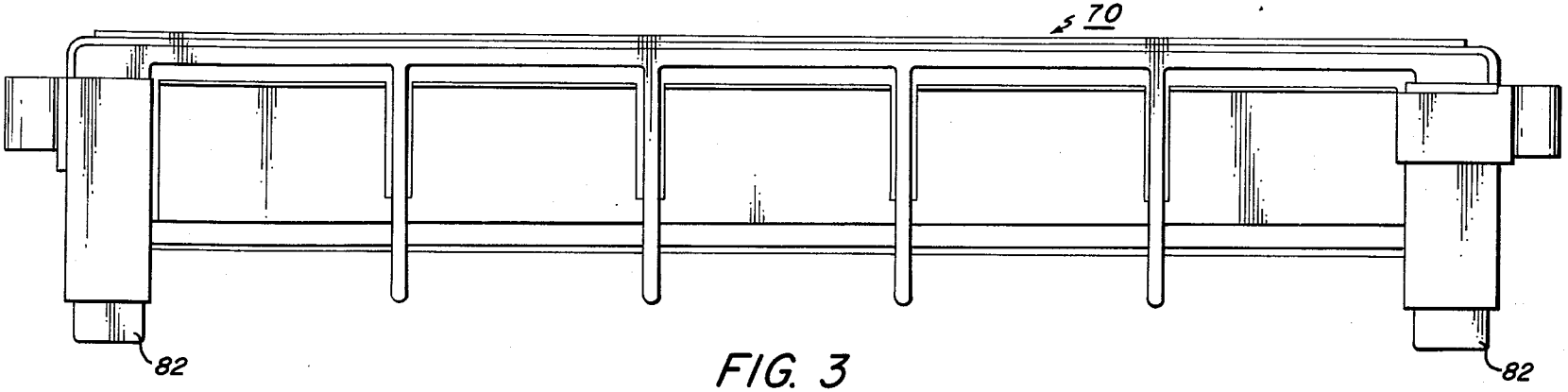
FIG. 3 is a fragmentary plan view showing the sealing arrangement of the FIG. 2 release material applicator.
Figure 4:
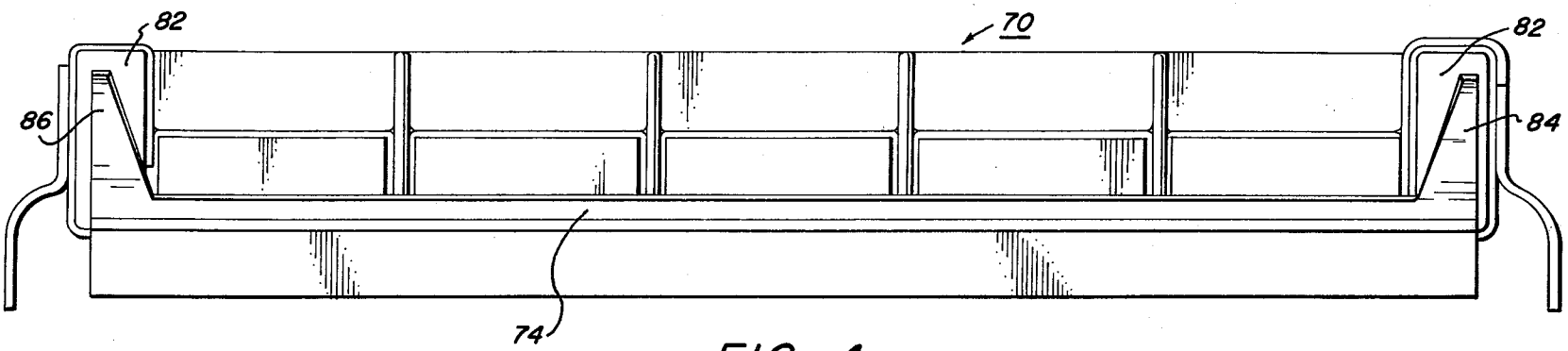
FIG. 4 is a fragmentary front elevational view illustrating the FIG. 3 sealing arrangement.

Referring to FIGS. 3 and 4, resilient pads 82, secured to housing 70, act as sealing means to prevent sidewise leakage of the release material along the longitudinal axis of fuser roll 50 between the edge of metering blade 74 and fuser roller 50. Preferably, pads 82 are made from a resilient material and are secured to housing 70. Pads 82 engage side marginal portions 84 and 86 of metering blade 74. Side marginal portions 84 and 86 are integral with metering blade 74 on opposed sides thereof. Side marginal portions 84 and 86 extend in an outwardly direction from the edge of metering blade 74 substantially normal thereto. Preferably, side marginal portions 84 and 86 are configured in the shape of truncated triangular pad. Blade 74 and truncated triangular pads 84 and 86 associated therewith extend in an outwardly direction therefrom and are preferably flexible, i.e., being made from a sheet of silicone rubber. A backup stiffener may be secured to blade 74. Preferably, this stiffener is made from a thin strip of brass, or in lieu thereof, stainless steel. Resilient pads 82 press truncated pads 84 and 86 into engagement with fuser roller 50. As truncated triangular pads 84 and 86 are pressed into engagement with fuser roller 50 they deform to form troughs. These troughs act as catches to prevent leakage of the release material moving in a sidewise direction parallel to the longitudinal axis of fuser roller 50. As previously noted, the edge of metering blade 74 is closely adjacent to fuser roller 50 as the latter rotates through chamber 72 of housing 70. In this way, the quantity of release material coated on the surface of fuser roller 50 is regulated while leakage from chamber 72 is prevented.

In recapitulation, it is apparent that the apparatus of the present invention applies release material to a fuser roller while preventing sidewise leakage of the release material during the application thereof. The foregoing is achieved by a sealing arrangement wherein flexible truncated pads extend in an outwardly direction from the metering blade on either side thereof. Resilient pads mounted on the housing engage the truncated triangular pads and press them into engagement with the fuser roller. This deforms the triangular pads. The deformed truncated triangular pads form troughs which prevent the leakage of release in a sidewise direction along the longitudinal axis of the fuser roller.

It is, therefore, evident that there has been provided in accordance with the present invention, an apparatus for applying release material to a fuser roller while preventing the leakage of the release material therefrom. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for applying a fluid release material to a fuser member in communication with a backup member as a sheet of support material having particles thereon passes therebetween with the particles contacting the fuser member, including:

a housing defining a chamber for storing a supply of release material in operative communication with the fuser member; and a blade member disposed closely adjacent to the fuser member for controlling the thickness of the layer of release material applied to the fuser member, said blade member comprising truncated triangular pads extending in an outwardly direction, substantially normal to the edge of said blade member at opposed, spaced side marginal regions thereof, each truncated triangular pad being resiliently urged into engagement with the fuser member to prevent leakage of the release material thereat.

2. An apparatus as recited in claim 1, further including a pair of opposed spaced resilient pads, each resilient pad being secured to a side marginal region of said housing and engaging one of the truncated triangular pads of said blade member to press each triangular pad into engagement with the fuser member so as to deform each triangular pad into troughs preventing sidewise leakage of the release material along the edge of said blade member adjacent to the fuser member.

3. An apparatus as recited in claim 2, further including means for heating said housing to maintain the release material substantially in a fluid state.

4. A fusing apparatus employed in an electrostatographic printing machine for affixing substantially permanently toner particles to a sheet of support material, including:

a heated fuser roll;

a backup roll in communication with said fuser roll such that the sheet of support material passes therebetween and the toner particles thereon contact said fuser roll;

a housing defining a chamber for storing a supply of release material in operative communication with said fuser roll; and a blade member disposed closely adjacent to said fuser roll for controlling the thickness of the layer of release material applied to said fuser roll, said blade member comprising truncated triangular pads extending in an outwardly direction substantially normal to the edge of said blade member at opposed, spaced side marginal regions thereof, each truncated triangular pad being resilient urged into engagement with said fuser roll to prevent leakage of the release material thereat.

5. A fusing apparatus as recited in claim 4, further including a pair of opposed spaced resilient pads, each resilient pad being secured to a side marginal region of said housing and engaging one of the truncated triangular pads of said blade member to press each triangular pad into engagement with said fuser roll so as to deform each triangular pad into the troughs preventing sidewise leakage of the release material along the edge of said blade member adjacent to said fuser roll.

6. A fusing apparatus as recited in claim 5, further including means for heating said housing to maintain the release material in a substantially fluid state.

* * * * *